US007845144B2

(12) United States Patent
Yuyama

(10) Patent No.: US 7,845,144 B2
(45) Date of Patent: Dec. 7, 2010

(54) MEDICINE STORING AND DISPENSING APPARATUS

(75) Inventor: Shoji Yuyama, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 81 days.

(21) Appl. No.: 12/307,744

(22) PCT Filed: Jul. 2, 2007

(86) PCT No.: PCT/JP2007/063216

§ 371 (c)(1),
(2), (4) Date: Jan. 6, 2009

(87) PCT Pub. No.: WO2008/004511

PCT Pub. Date: Jan. 10, 2008

(65) Prior Publication Data

US 2009/0289079 A1 Nov. 26, 2009

(30) Foreign Application Priority Data

Jul. 6, 2006 (JP) ..... 2006-186319

(51) Int. Cl.
*B65B 1/06* (2006.01)

(52) U.S. Cl. ..... 53/249; 141/171

(58) Field of Classification Search ..... 53/235, 53/249, 250, 253; 141/171; *B65B 1/06*
See application file for complete search history.

(56) References Cited

U.S. PATENT DOCUMENTS 1,949,536 A * 3/1934 Ferguson ..... 141/171
2,325,816 A * 8/1943 Waters ..... 53/250
3,105,526 A * 10/1963 Hurtig ..... 141/171
3,267,971 A * 8/1966 Mueller ..... 141/9
3,421,555 A * 1/1969 Minard et al. ..... 141/171
3,461,646 A * 8/1969 Lane et al. ..... 53/253
4,103,720 A 8/1978 Eisenberg
4,349,053 A * 9/1982 Eisenberg ..... 141/171
5,791,385 A * 8/1998 Stahlecker ..... 141/171
6,581,355 B1 * 6/2003 Yuyama et al. ..... 53/250
6,648,025 B2 * 11/2003 Smith et al. ..... 141/9

(Continued)

FOREIGN PATENT DOCUMENTS

JP 54-26193 2/1979

(Continued)

OTHER PUBLICATIONS

International Search Report for PCT/JP2007/063216, in English and Japanese, 3 pages (mailed Jul. 31, 2007).

*Primary Examiner*—Stephen F Gerrity
(74) *Attorney, Agent, or Firm*—Jones Day; Anthony M. Insogna; Christopher C. Bolten

(57) ABSTRACT

There is provided a medicine storing and dispensing apparatus, which is capable of filling medicines dispensed from a medicine feeder into a container generally evenly regardless of location to thereby effectively utilize an internal space of the container. The medicine storing and dispensing apparatus has arms 72, 73 and is capable of filling tablets into a vial B held by the arms. A drive roller 101, which is rotated by a motor, is provided at the arm 72. The medicine storing and dispensing apparatus can rotate the vial B by rotating the drive roller 101 when filling the tablets into the vial B held by the arms 72, 73.

4 Claims, 9 Drawing Sheets

U.S. PATENT DOCUMENTS

2004/0219119 A1* 11/2004 Wei et al. ..... 424/70.1
2006/0163271 A1* 7/2006 Hatsuno et al. ..... 221/112

FOREIGN PATENT DOCUMENTS

JP 56-3242 1/1981
JP 62-168802 7/1987
JP 2005-211540 8/2005

* cited by examiner

MEDICINE STORING AND DISPENSING APPARATUS

CROSS-REFERENCE TO RELATED APPLICATIONS

This application is a 35 U.S.C. §371 U.S. national stage filing of International Patent Application No. PCT/JP2007/063216, filed Jul. 2, 2007, which claims the benefit of Japanese Patent Application No. 2006-186319, filed Jul. 6, 2006, the entire contents of both of which are incorporated herein by reference.

TECHNICAL FIELD

The present invention relates to a medicine storing and dispensing apparatus, which is capable of dispensing a medicine accommodated in a medicine feeding means into a container such as a vial.

BACKGROUND ART

Japanese Laid-Open Patent Publication No. 2005-211540 provides a conventional medicine storing and dispensing apparatus capable of filling a medicine accommodated in a medicine feeding means (referred to as a tablet cassette) into a container such as a vial. The medicine storing and dispensing apparatus disclosed in the above reference includes a conveying robot capable of moving a vial in the vicinity of a tablet cassette, which accommodates predetermined medicines therein, while holding the vial.

The medicine storing and dispensing apparatus disclosed in the above reference is formed such that the vial faces a dispensing port of the tablet cassette as tilted by the conveying robot and the medicine dispensed from the tablet cassette is delivered into the vial. Further, such an apparatus is configured to perform an oscillation motion for changing a tilt of the vial by about 5 degrees when the amount of the filled medicine reaches more than 65% of the volume of the vial. This is to prevent the medicine dispensed out of the tablet cassette from flowing out when delivering the vial to a next process.

SUMMARY OF THE INVENTION

As described above, the medicine storing and dispensing apparatus disclosed in the above document performs an operation referred to as an oscillation motion and fills the medicine up to about 65% of the volume of the vial to prevent such medicine from flowing out while delivering the vial. As such, the medicine becomes filled. However, as shown in FIG. 9(*a*), there is a problem in that when the tilted vial is viewed from its lateral side, the medicine cannot be filled into a space above a boundary line L passing a lower end of an opening of the vial. That is, a problem occurs in that a dead space D1 is produced in an internal region of the vial and the internal space of the vial cannot be effectively utilized for filling of the medicine.

Further, when the vial is not tilted but rather approximately vertically placed, as shown in FIGS. 9(*b*) and 9(*c*), the medicine dispensed from the tablet cassette tends to concentrate at one side in the internal space of the vial. That is, when the tablets fall from an upper side to an approximately central region of the vial, as indicated by an arrow in FIG. 9(*b*), a problem occurs in that the tablets concentrate at the approximately central region as hatched in FIG. 9(*b*). Thus, both lateral sides of the central region become dead spaces D2. Also, when the tablets fall from an upper side to the vicinity of a one side of the vial, as indicated by an arrow shown in FIG. 9(*c*), there is a problem in that the tablets concentrate near the falling position and a dead space D3 is produced laterally thereto. Accordingly, the vial must be shaken by performing the above-mentioned oscillation motion or any flat member must flatten the level of the medicine filled in the vial by press-contact thereto. This is to evenly fill the medicine into the vial without depending on its regions and to enhance a filling density.

Thus, it is an object of the present invention to provide a medicine storing and dispensing apparatus, which can generally evenly fill a medicine dispensed from a medicine feeding means into a container (e.g., a vial) without depending on its regions, and which can effectively utilize an internal space of the container for filling of the medicine.

In some embodiments, the invention, which is provided to solve the foregoing problems, is a medicine storing and dispensing apparatus, comprising: a medicine feeding means for accommodating medicines and dispensing the accommodated medicines; and a container holding means for holding a container, wherein the container holding means has a holding portion and a container rotating means, and wherein the container holding means rotates the container with the container rotating means while holding the container with the holding portion while the medicine feeding means dispenses the accommodated medicines into the container.

The medicine storing and dispensing apparatus can rotate the container when it is held with the holding portion. Thus, the medicine storing and dispensing apparatus can prevent the medicine dispensed from the medicine feeding means from being distributed at one region of the container and allow the medicine to be generally evenly accommodated in the container. As such, the medicine storing and dispensing apparatus allows most of the volume of the container to be effectively utilized for filling of the medicine.

The medicine storing and dispensing apparatus optionally may be characterized in that the container is a cylindrical body with a bottom, wherein the cylindrical body extends along a predetermined axis. Further, the medicines dispensed from the medicine feeding means are filled into the container when the container is held by the container holding means such that an axial direction of the container is inclined with respect to a vertical line.

Further, the medicine storing and dispensing apparatus optionally may be characterized in that the container is a cylindrical body with a bottom, wherein the cylindrical body extends along a predetermined axis. Also, the medicines dispensed from the medicine feeding means may be filled into the container when the container is held by the container holding means such that an axial direction of the container is inclined within a range from a vertical state to 60 degrees with respect to a vertical line.

The medicine storing and dispensing apparatus optionally may be constructed such that the holding portion includes a pair of arms that are movable towards and away from each other. Further, the container may be held by reducing a space between the pair of the arms and may be released by increasing the space between the pair of the arms. Also, a roller is provided at both or one of the arms, wherein the roller receives power from an actuator to thereby rotate, and wherein the roller can be brought into contact with an outer peripheral surface of the container when the holding portion holds the container.

According to such construction, while the container for filling of the medicine is held by the pair of the arms, the container can be rotated by operating the actuator.

The medicine storing and dispensing apparatus optionally may be constructed such that the medicine feeding means comprises: a plurality of medicine cassettes disposed in rows; and a container conveying means for moving the container holding means towards and/or away from the medicine cassette, wherein the medicine cassette and the container holding means are relatively moved in a direction where the medicine feeding means is in a row.

According to such construction, the medicine storing and dispensing apparatus can fill the medicine accommodated in the predetermined medicine feeding means into the container while optimally using the capacity (volume) of the container. This can be achieved by moving the container holding means towards and/or away from the medicine feeding means while relatively moving a medicine supplying rack and the container holding means in a direction where the medicine feeding means are in a row.

According to some embodiments of the present invention, the medicine storing and dispensing apparatus can generally evenly fill the medicine dispensed from the medicine feeding means into a container such as a vial without depending on regions of the vial, and can effectively utilize an internal space of the container for filling of the medicines.

DESCRIPTION OF REFERENCE NUMERALS

1 . . . Medicine storing and dispensing apparatus
30 . . . Tablet feeding means (medicine feeding means)
35 . . . Tablet cassette
50 . . . Container conveying means
55 . . . Container holding means
72, 73 . . . Arms (holding portion)
100 . . . Container rotating mechanism (container rotating means)
101 . . . Drive roller
102~104 . . . Free roller
B . . . Vial (container)
H . . . Axis
V . . . Vertical line

DETAILED DESCRIPTION

Figure 1:
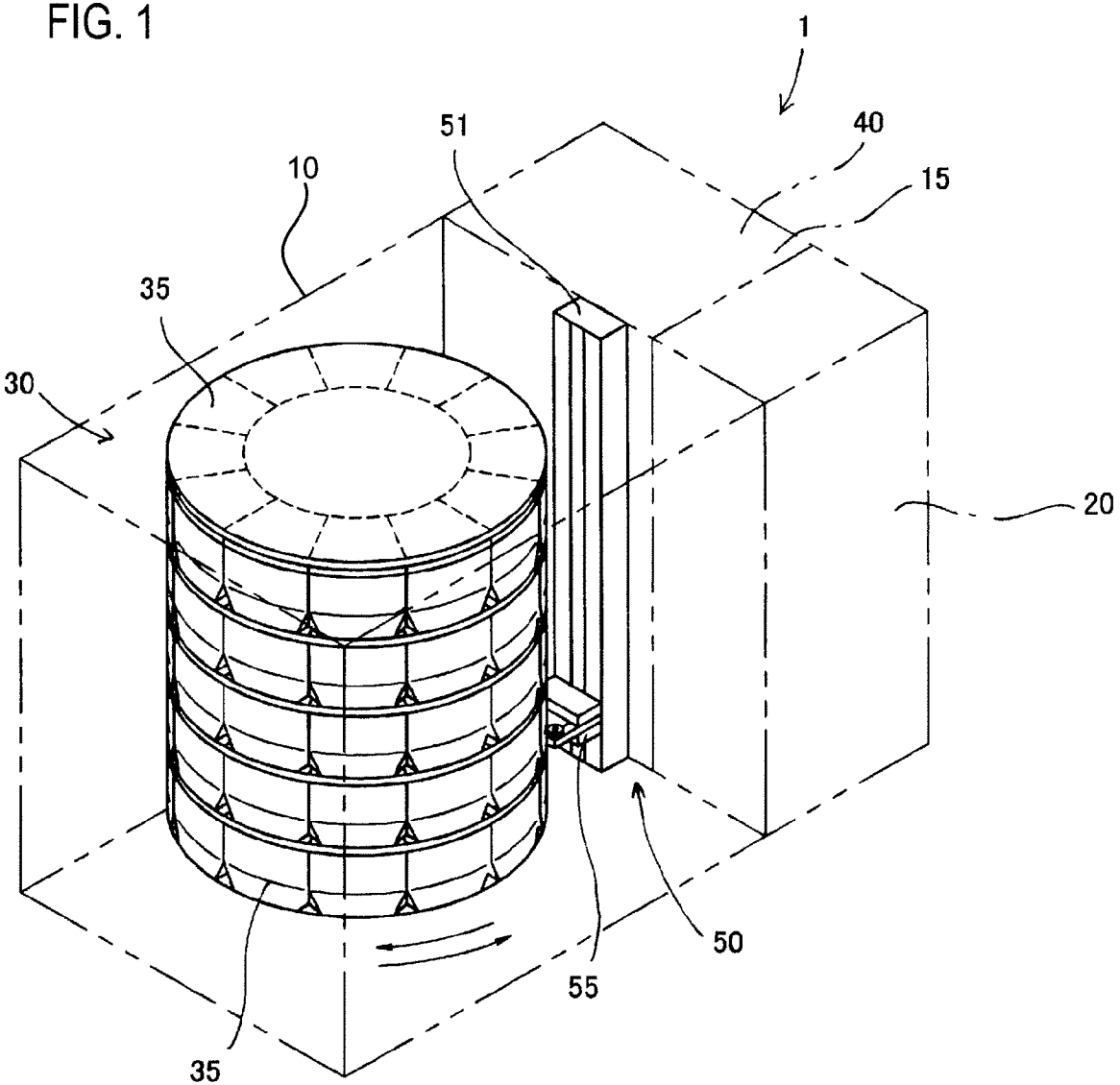
FIG. 1 is a perspective view showing a medicine storing and dispensing apparatus according to one embodiment of the present invention.

Hereinafter, a medicine storing and dispensing apparatus 1 according to one embodiment of the present invention will be described in detail with reference to the accompanying drawings. As shown in FIG. 1, the medicine storing and dispensing apparatus 1 includes the following within a box-shaped main body 10: a container feeding means 20; a tablet feeding means (medicine feeding means) 30; and a container sealing means 40. Further, the medicine storing and dispensing apparatus 1 includes a container conveying means 50. Furthermore, the medicine storing and dispensing apparatus 1 includes a control means 15, which controls operations of the container feeding means 20, the tablet supplying means 30, the container sealing means 40, the container conveying means 50, etc.

The container feeding means 20 is disposed at a right side of the main body 10 when the main body is viewed from its front side. The container feeding means accommodates a plurality of vials (containers) B therein, which have a cylindrical shape with a bottom and comprises an opening at its upper end side. The container feeding means 20 can dispense the vial B one at a time based on a control command from the control means 15.

The tablet feeding means 30 is constructed such that a plurality of tablet cassettes (medicine cassettes) 35 are mounted on a cylindrical drum body 31 in vertical and circumferential directions to be removed therefrom, if necessary, as shown in FIG. 1. The tablet cassette 35 may accommodate predetermined tablets (medicines) therein and, if necessary, dispense the accommodated tablets one at a time.

Figure 2:
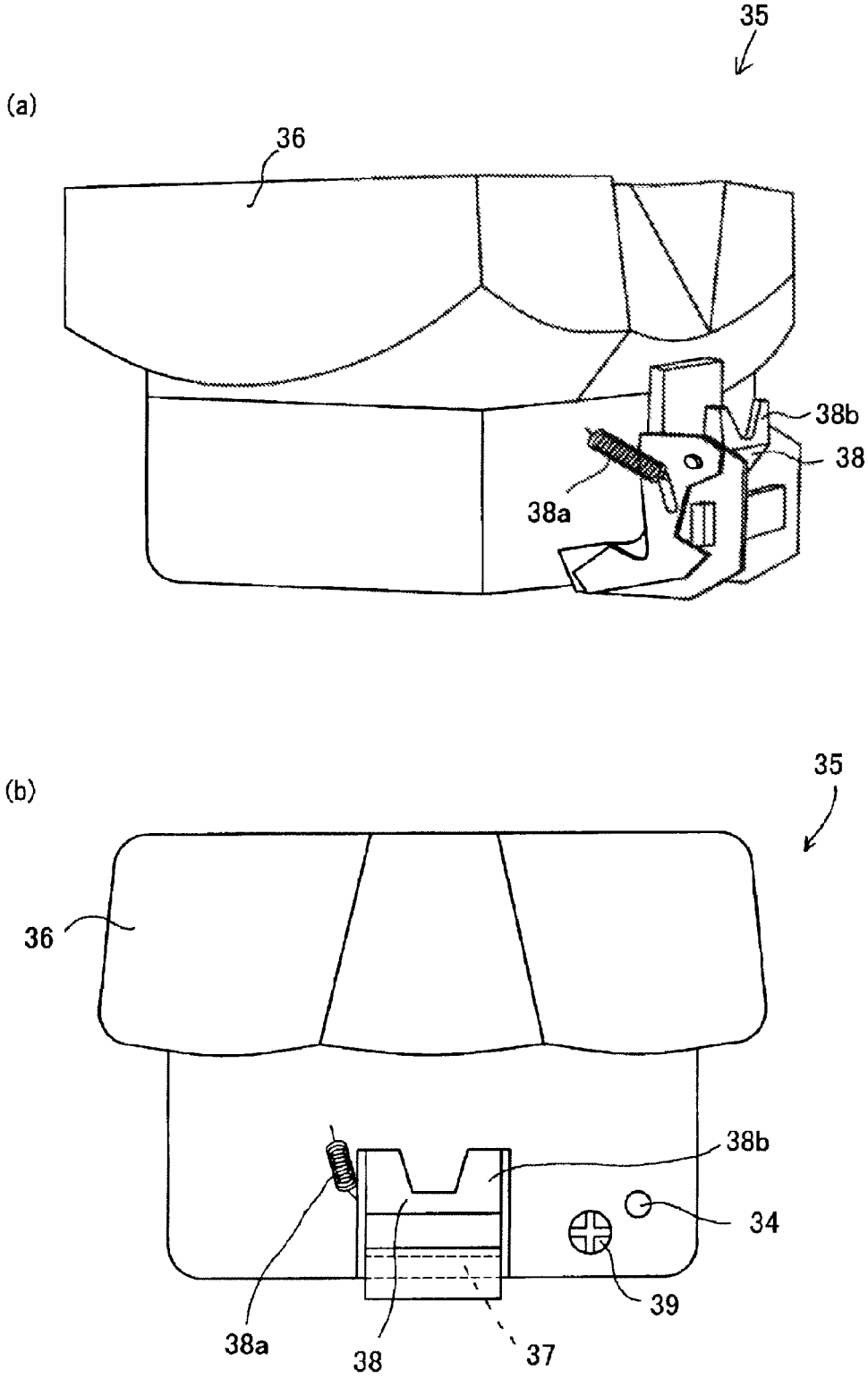
FIG. 2(*a*) is a perspective view of a tablet cassette and FIG. 2(*b*) is a front elevation view of the tablet cassette.

More specifically, as shown in FIGS. 2(*a*) and 2(*b*), the tablet cassette 35 includes: an accommodating section 36 configured to accommodate tablets therein; a discharge port 37 for dispensing the tablets; and a dispensing mechanism (not shown) for dispensing the tablets from the accommodating section 36 toward the discharge port 37. Further, a lid member 38 is mounted to the discharge port 37 of the tablet cassette 35. A spring 38*a* is mounted between the tablet cassette 35 and the lid member 38. The lid member 38 is biased by the spring 38*a* to thereby close the discharge port 37 at normal times. However, if an upper end portion 38*b* of the lid member 38 is pressed down, then the discharge port 37 becomes open and the tablets are permitted to be dispensed therefrom.

As shown in FIG. 2(*b*), the tablet cassette 35 has a connecting part 39, which is coupled to a power transmission mechanism forming the dispensing mechanism, and a positioning hole 34 at its front side. The tablet cassette 35 can actuate the power transmission mechanism by a power transmitted from the outside via the connecting part 39 and discharge the tablets accommodated in the accommodating section 36 out of the discharge port 37. The positioning hole 34 is provided near the connecting part 39. A positioning shaft 76, which is provided at a body of the holding means 70 of the container conveying means 50, can be fitted into the positioning hole.

Further, the drum body 31, which forms the tablet feeding means 30, is connected to a motor (not shown). The drum body may rotate in a circumferential direction as shown by arrows in FIG. 1 through using power of the motor. That is, the medicine storing and dispensing apparatus 1 can relatively move the tablet cassettes 35, which are arranged in rows around the drum body 31, with respect to the container conveying means 50 by rotating the tablet feeding means 30.

The tablet sealing means 40 is provided so as to fit a cap to the opening of the vial B, which is filled with tablets at the tablet feeding means 30. A conveying means (not shown)

conveys the vial B sealed up by the container sealing means 40 up to a position where a user of the medicine storing and dispensing apparatus 1 may remove it.

The medicine storing and dispensing apparatus 1 of this embodiment includes container conveying means 50 capable of conveying the vial B throughout the container feeding means 20, the tablet feeding means 30 and the container sealing means 40. As shown in FIG. 1, the container conveying means 50 is constructed such that a container holding means 55 is mounted to a supporting pillar 51 located adjacent to the tablet feeding means 30.

Figure 3:
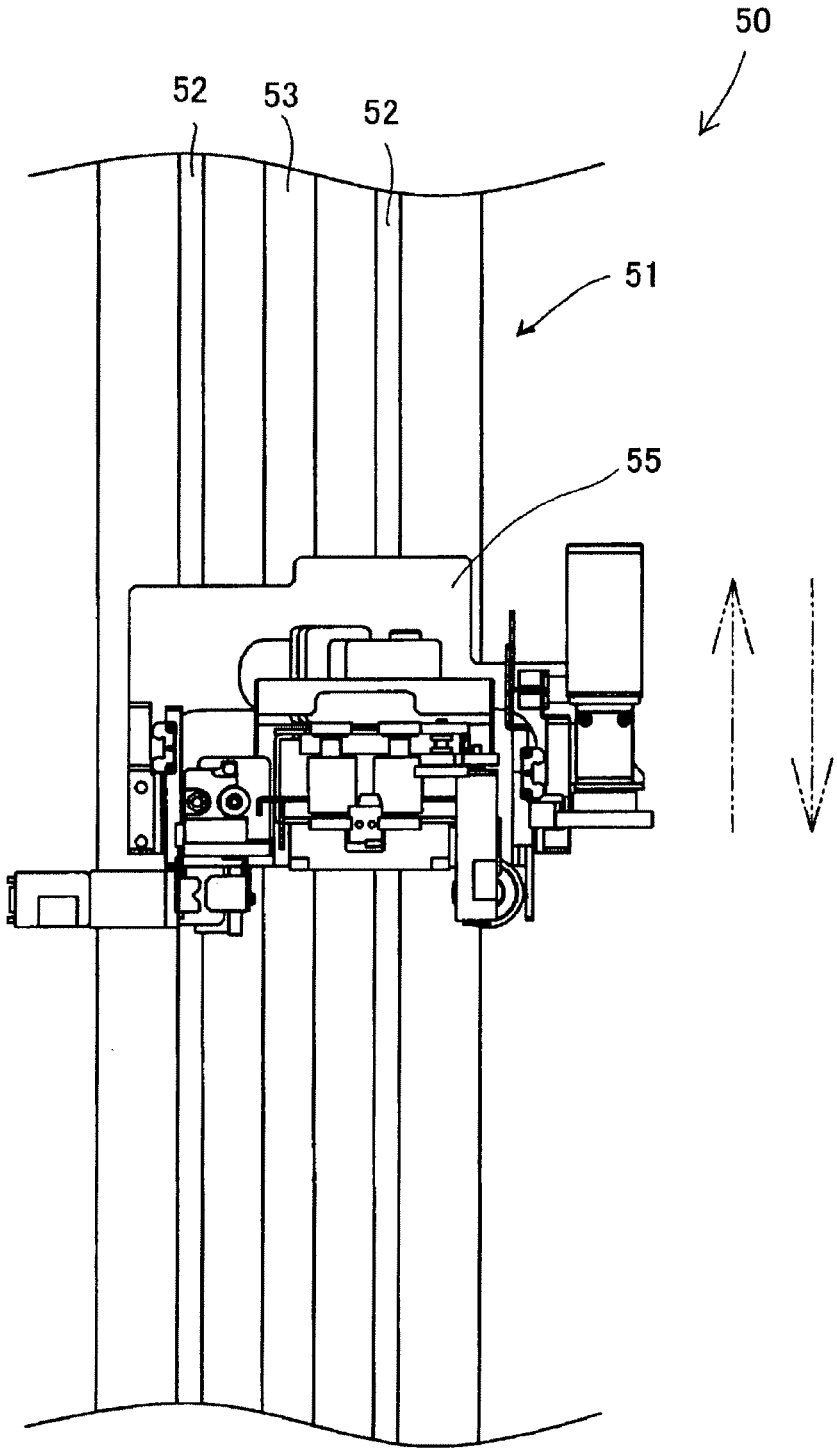
FIG. 3 is a front elevation view of a container conveying means.

The supporting pillar 51 has a vertically elongated pillar-shaped body, as shown in FIGS. 1 and 3. The supporting pillar is fixed to the main body 10 of the medicine storing and dispensing apparatus 1 at its upper and lower ends. Two guide rods 52, 52, which vertically extend, are mounted to the supporting pillar 51. Further, a gear belt 53 is mounted to the supporting pillar 51 along the guide rods 52, 52. The gear belt 53 is suspended between a drive gear (not shown) mounted to the upper end side of the supporting pillar 51 and a pulley gear (not shown) coupled to the lower end side of the supporting pillar. As indicated by arrows shown in FIG. 3, the gear belt 53 is upwardly and downwardly movable by means of the power of a motor (not shown) connected to the drive gear.

Figure 4:
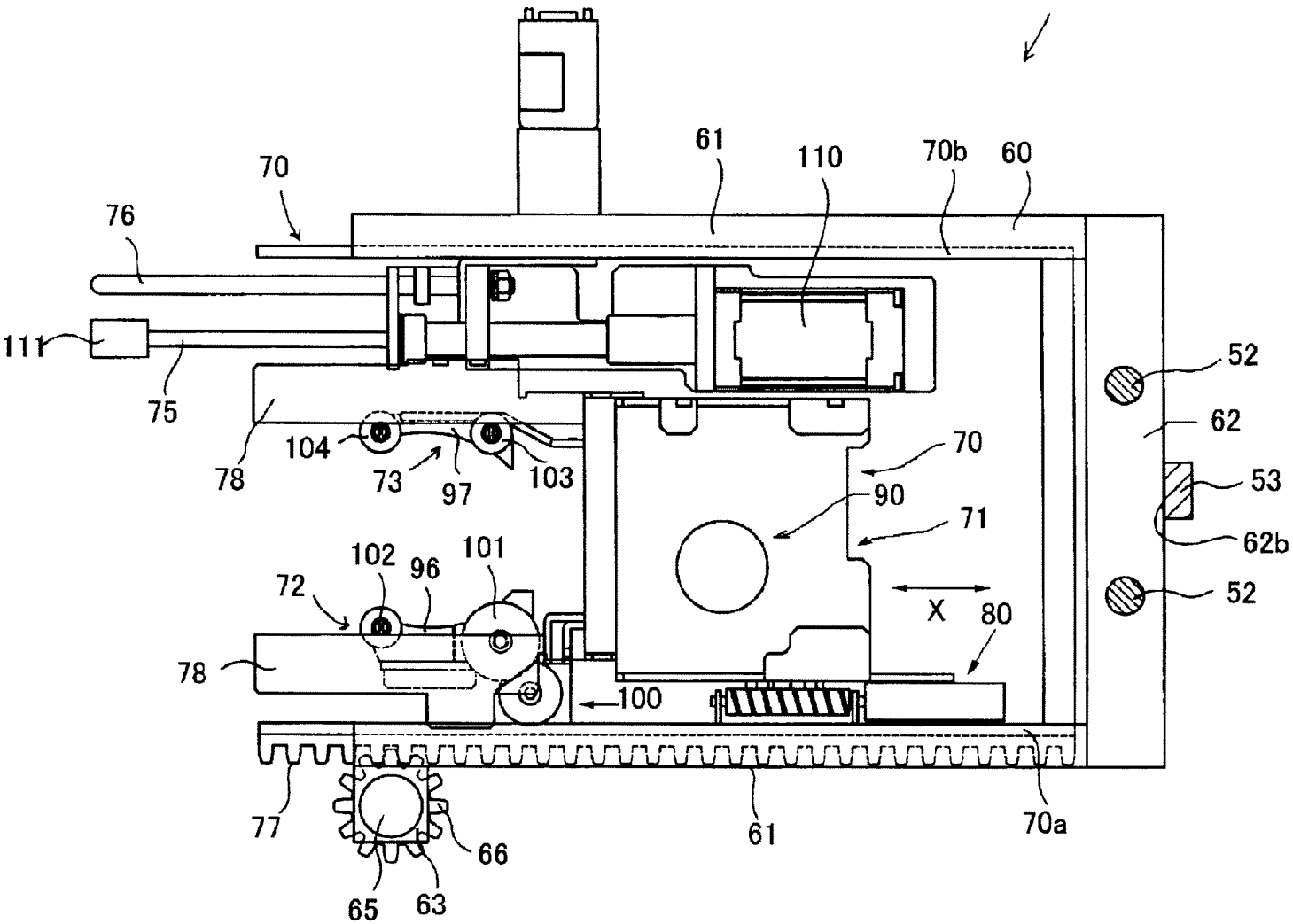
FIG. 4 is a plan view of the container conveying means.
Figure 5:
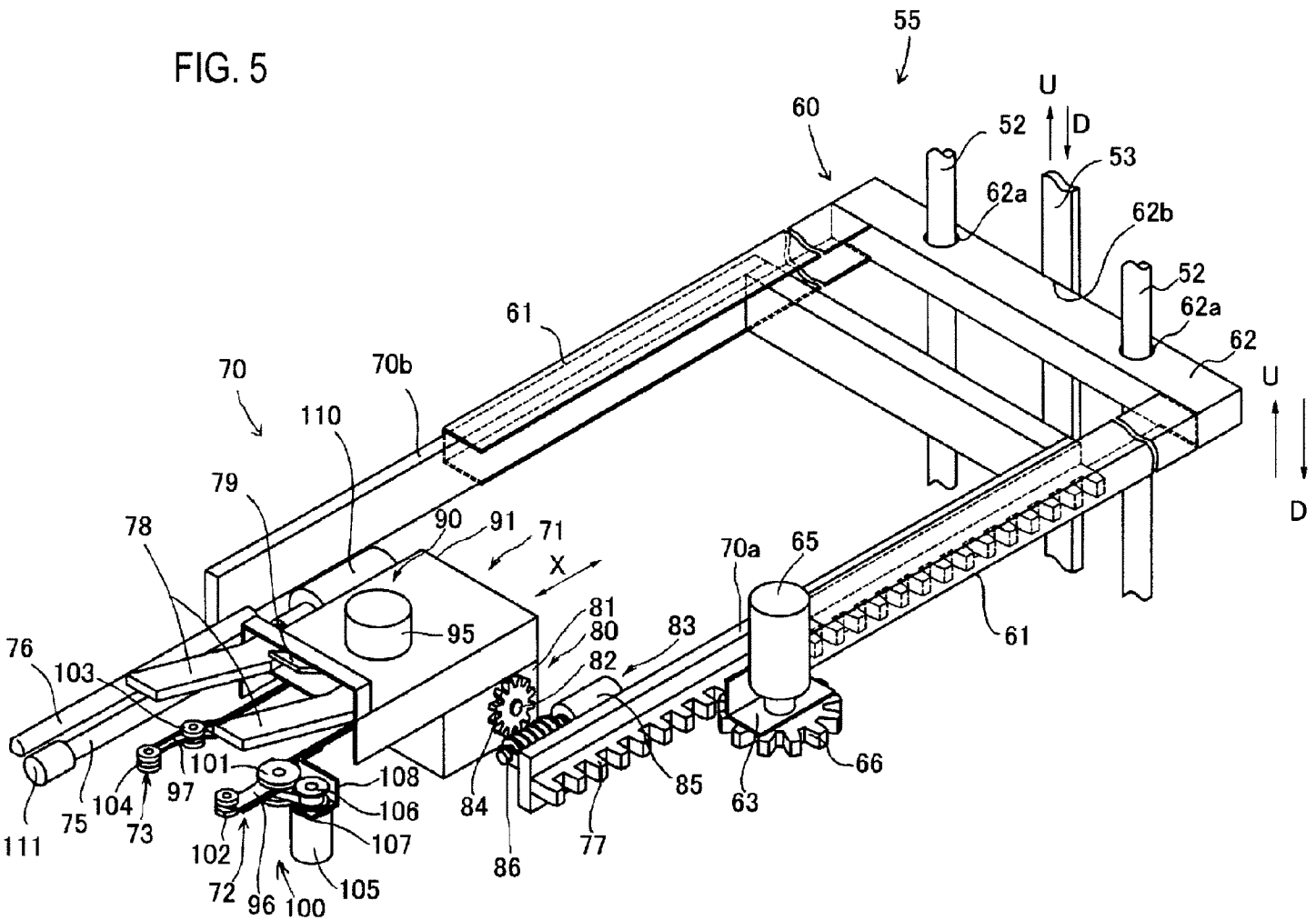
FIG. 5 is a perspective view of the container conveying means.

As shown in FIGS. 4 and 5, the container holding means 55 has a frame 60, which has an approximate U-shape, and a body of holding means 70 that can move with respect to the frame 60. The frame 60 has elongated guide portions 61, 61, which are arranged opposite to each other, and an end member 62 mounted to ends of the guide portions 61, 61 to be approximately perpendicular to both guide portions. As described below, the guide portions 61, 61 are members serving as a guide, which freely and slidably supports the body of holding means 70.

As shown in FIGS. 4 and 5, the frame 60 is movably mounted to the supporting pillar 51 by coupling the guide rods 52, 52 and the gear belt 53 provided at the supporting pillar 51 to the end member 62. Specifically, the end member 62 has through-holes 62*a*, 62*a*, which the guide rods 52, 52 can be inserted into, and a belt attachment 62*b*. The guide rods 52, 52 are mounted to the through-holes 62*a*, 62*a* to vertically pass therethrough. Also, the gear belt 53 provided at the supporting pillar 51 is fixed to the belt attachment 62*b* of the end member 62. Thus, when the gear belt 53 is brought into movement, the frame 60 is moved upward and downward (e.g., in a direction of an arrow U or arrow D shown in FIG. 5) as guided by the guide rods 52, 52 passing through the end member 62 while maintaining a uniform position.

Further, a motor mount 63, which projects outwardly of the frame 60, is provided at one of the guide portions 61, 61 (e.g., the guide portion 61 located downward in FIG. 4) of the frame 60. A motor 65 is attached to the motor mount 63 as directing its rotating shaft downwardly. A pinion 66 is mounted to the rotating shaft of the motor 65. The pinion 66 meshes to a rack 77 provided at the body of holding means 70, thereby providing a moving mechanism for forwardly and backwardly moving the body of the holding means 70.

The body of the holding means 70 includes a drive mechanism section 71 as a main component. The body of the holding means 70 is formed such that the arms (holder portion) 72, 73, the tablet cassette operating shaft 75, the positioning shaft 76, the rack 77, a sensor 78, etc. are mounted to the drive mechanism section. More specifically, the drive mechanism section 71 includes the following: a tilting mechanism section 80 for upwardly and downwardly tilting the body of the holding means 70; an arm operating mechanism 90 for operating the arms 72, 73; a container rotating mechanism (container rotating means) 100 for rotating the vial B held by the arms 72, 73; and a motor 110 for driving the tablet cassette operating shaft 75.

As shown in FIG. 5, the tilting mechanism section 80 has a box-shaped body of the tilting mechanism 81, a shaft 82 traversing and fixed to the body of the tilting mechanism, and a drive source 83. One end of the shaft 82 is supported on a frame that forms a portion of the body of the holding means 70. Further, an opposite end of the shaft 82 projects toward a lateral side of the body of the tilting mechanism 81. A gear 84 is fixed to such a projecting side of the shaft.

The drive source 83 includes a motor 85 and a worm gear 86 mounted to a rotating shaft of the motor. The drive source 83 is provided separately to the body of the tilting mechanism 81 and is supported on the frame forming a portion of the body of the holding means 70. The worm gear 86 provided at the drive source 83 meshes to a gear 84 of the body of the tilting mechanism 81, thereby forming a so-called worm and wheel mechanism. Thus, when the motor 85 is operated, the worm gear 86 and the gear 84 are rotated and the tilt of the body of tilting mechanism 81 can be changed accordingly.

Figure 6:
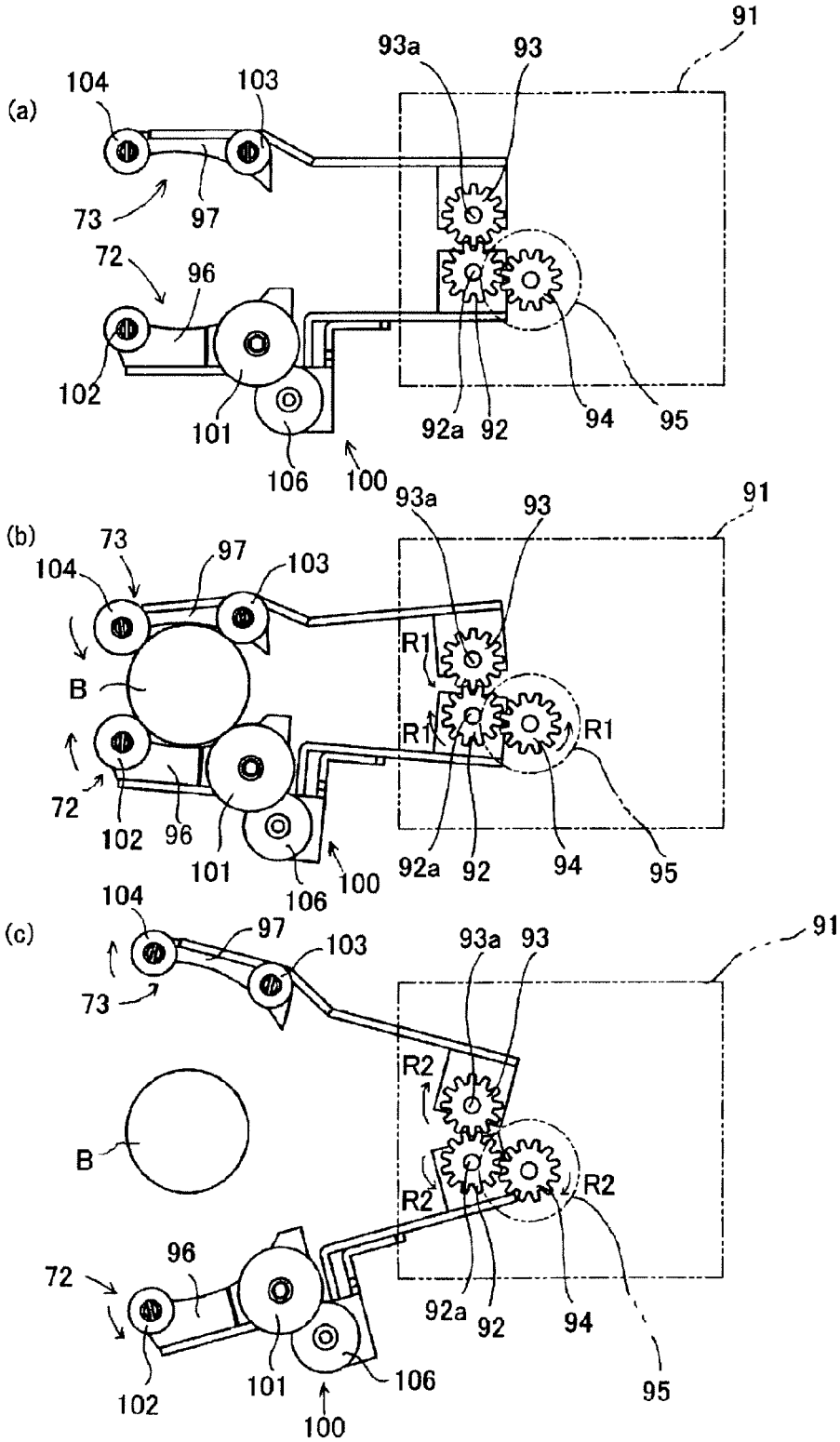
FIG. 6(*a*) schematically shows arms and an arm operating mechanism, FIG. 6(*b*) schematically shows the arms when closed and FIG. 6(*c*) schematically shows the arms when opened.

A main component of the arm operating mechanism 90 comprises: a gear mechanism accommodated in a body of an arm operating mechanism 91, which is fixed to an upper side of the body of the tilting mechanism 81; and a motor 95 provided at the exterior of the body of the arm operating mechanism 91. More specifically, as shown in FIG. 6, the gear mechanism including gears 92, 93, 94 is mounted inside the body of the arm operating mechanism. The gears 92, 93 are mounted to one end sides (i.e., base end sides) of the arms 72, 73 such that they are rotatable about shafts 92*a*, 93*a* integrally formed together with the arms 72, 73 and mesh to each other. That is, when the gear 92 rotates about the shaft 92*a*, the arm 72 is rotated in conjunction therewith. Further, when the gear 93 rotates about the shaft 93*a*, the arm 73 is rotated in conjunction therewith.

The gear 94 is mounted to a rotating shaft of the motor 95, which is mounted to a top surface of the body of the arm operating mechanism 91. The gear 94 is configured to rotate by means of the power of the motor 95. Further, the gear 94 meshes to the gear 92 mounted to the arm 72. Thus, as the rotating shaft of the motor 95 is rotated in one direction (hereinafter referred to as a normal direction) as indicated by an arrow R1 of FIG. 6(*b*), the gear 92 and the arm 72 are rotated clockwise (in a right rotation) about the shaft 92*a*, whereas the gear 93 and the arm 73 are rotated counterclockwise (in a left rotation) about the shaft 93*a*. As such, a space formed between leading end sides of the arms 72, 73 becomes smaller. Accordingly, the vial B can be sandwiched by the arms 72, 73.

On the other hand, when the rotating shaft of the motor 95 is rotated in a direction opposite to the foregoing direction (hereinafter referred to as a reverse direction) as indicated by an arrow R2 of FIG. 6(*c*), the gear 92 and the arm 72 are rotated counterclockwise about the shaft 92*a*. Further, the gear 93 and the arm 73 are rotated clockwise about the shaft 93*a*. Thus, the space formed between the leading end sides of the arms 72, 73 becomes larger. As such, the vial B sandwiched between the arms 72, 73 can be released therefrom.

As shown in FIGS. 4 and 6, a left-hand holding member 96 and a right-hand holding member 97 are provided at the leading end sides of the arms 72, 73, respectively. The left-hand holding member 96 and the right-hand holding member 97 have a curved shape when viewed at a plane. The curved shapes of the left-hand holding member 96 and the right-hand holding member 97 are configured to correspond to an outer peripheral surface of the vial B when the vial B is held (or sandwiched) by the arms 72, 73, as shown in FIG. 6(*b*). A drive roller 101 and a free roller 102, which form a container rotating mechanism 100, are rotatably mounted to the left-hand holding member 96. Further, free rollers 103, 104 are mounted to the right-hand holding member 97.

In addition to the above-described drive roller 101 and free rollers 102 to 104 coupled to the arms 72, 73, the container rotating mechanism 100 includes: a motor 105, which serves as a drive source for the drive roller 101; a pulley 106 for transmitting power from the motor 105 to the drive roller 101; and a belt 107 suspended between the pulley 106 and the drive roller 101 (shown in FIG. 5). The motor 105 is fixed to a motor supporting piece 108 mounted in the midsection of the arm 72 with its rotating shaft vertically directed. The pulley 106 is mounted to the rotating shaft of the motor 105. Thus, when the motor 105 is operated, rotating power produced by the motor 105 is transmitted to the drive roller 101 via the belt 107, and the drive roller 101 is rotated thereby.

As shown in FIGS. 4 and 5, the body of holding means 70 has elongated side frames 70*a*, 70*b* at both lateral sides of the drive mechanism section 71. The side frames 70*a*, 70*b* are mounted so as to be freely slidable in a length direction of the guide portions 61, 61 relative to the guide portions 61, 61 of the frame 60, respectively.

The rack 77 is mounted to a lateral side of the side frame 70*a*. The rack 77 meshes to the pinion 66 mounted to the rotating shaft of the motor 65, which is provided at the motor mount 63 of the frame 60, thus providing the moving mechanism for moving the body of the holding means 70 forward and backward as indicated by an arrow X in FIGS. 4 and 5. Thus, the container conveying means 50 can move the body of the holding means 70 in the length direction of the guide portions 61, 61 (i.e., in the direction indicated by the arrow X) by actuating the motor 65, thereby rotating the pinion 66.

As shown in FIGS. 4 and 5, the body of the holding means 70 has the tablet cassette operating shaft 75 and the positioning shaft 76, which are located near the side frame 70*b*. The tablet cassette operating shaft 75 extends along the guide portions 61, 61. The tablet cassette operating shaft 75 is configured such that one end side (base end side) thereof is connected to the motor 110 and a connecting member 111 is coupled to the opposite end side (leading end side) thereof.

The connecting member 111 is provided at a place where it can engage the connecting part 39 provided at the tablet cassette 35 when the body of the holding means 70 approaches the tablet cassette. Thus, as the body of the holding means 70 approaches the tablet cassette 35 in order to dispense the tablets accommodated in the tablet cassette 35 to the vial B, the connecting member 111 and the connecting part 39 can be connected to each other. Further, as the motor 110 is actuated with the connecting member 111 and the connecting part 39 connected to each other, the dispensing mechanism provided at the tablet cassettes 35 is actuated. As such, the tablets accommodated in the tablet cassettes 35 can be dispensed through the discharge port 37.

The positioning shaft 76 is a shaft body extending along the tablet cassette operating shaft 75. The positioning shaft 76 is used for positioning the body of the holding means 70 and the tablet cassette 35. That is, when the body of the holding means 70 becomes close to the tablet cassette 35, if a positional relation between the body of the holding means 70 and the tablet cassette 35 are situated at a position where the tablets can be dispensed from the tablet cassettes 35 to the vial B held by the body of holding means 70, the positioning shaft 76 is inserted into the positioning hole 34. Thus, the body of the holding means 70 and the tablet cassette 35 are positionally matched.

The sensors 78, 78 are provided at an upper side of the body of the tilting mechanism 81. A light-emitting part (not shown) is provided at one of the sensors 78, 78, while a light-receiving part (not shown) is provided at another sensor.

The sensors 78, 78 are situated so as to be approximately orthogonally opposed to the discharge port 37 when the body of the holding means 70 becomes close to a predetermined one of the tablet cassettes 35 and the lid member 38 provided at the discharge port 37 of the tablet cassette 35 is opened by a pressing piece 79. Further, the sensors 78, 78 are situated such that the light-emitting part and the light-receiving part are opposed to each other across an opening (not shown) provided at the lid member 38 when the lid member 38 is opened by the pressing piece 79. Accordingly, the medicine storing and dispensing apparatus 1 according to this embodiment can count the quantity of the tablets, which pass through the discharge port 37 and are dispensed into the vial B, by moving the body of the holding means 70 closely to the tablet cassette 35 to thereby open the discharge port 37.

Further, the pressing piece 79 is provided between the sensors 78, 78. The pressing piece 79 is positioned at a place where it can press the vicinity of the upper end of the lid member 38 provided at the tablet cassette 35 when the body of the holding means 70 becomes close to the predetermined tablet cassette 35. That is, as the body of the holding means 70 approaches the tablet cassette 35, the lid member 38 is pressed down and the discharge port 37 can be opened thereby.

Subsequently, the operations of the medicine storing and dispensing apparatus 1, which is associated with performing a filling operation for the medicine into the vial B, will be described while emphasizing the operations of the container conveying means 50. When the tablets are dispensed to the vial B by the medicine storing and dispensing apparatus 1, the control means 15 actuates the container feeding means 20 to dispense the vial B therefrom. Further, the control means 15 moves the container conveying means 50 up to a position where the vial B is dispensed by the container feeding means 20.

More specifically, the control means 15 actuates the motor (not shown) for moving the gear belt 53, which is provided at the supporting pillar 51 of the container conveying means 50, to thereby move the container holding means 55 up to a height corresponding to the dispensing position of the vial B. If a height adjustment of the container holding means 55 is thus completed, then the control means 15 slides the body of the holding means 70 and protrudes it toward the vial B by actuating the motor 65 provided to the frame 60 of the container holding means 55 to thereby rotate the pinion 66.

While the height adjustment of the body of the holding means 70 of the container conveying means 50 is carried out as described above, the control means 15 actuates the arm operating mechanism 90 to allow a body portion of the vial B to be held by the arms 72, 73. More specifically, the control means 15 actuates the motor 95 to rotate the gear 94 counterclockwise (in a direction indicated by an arrow R2 of FIG. 6(*c*)). Thus, the gear 92 engaging the gear 94 as well as the gear 93 engaging the gear 92 are rotated about the shafts 92*a*, 93*a* in the direction indicated by the arrow R2. Accordingly, as shown in FIG. 6(*c*), the leading end sides of the arms 72, 73 are opened.

If the body of the holding means 70 of the container conveying means 50 reaches the dispensing position of the vial B with the arms 72, 73 opened as described above, the vial B is placed between the arms 72, 73 as shown in FIG. 6(*c*). If such a state is accomplished, then the control means 15 rotates the gear 94 in a reverse direction opposite to the foregoing (i.e., in the direction indicated by the arrow R1) as shown in FIG. 6(*b*). Thus, each of the gears 92, 93, 94 is rotated in the direction indicated by the arrows R1 and the leading end sides of the arms 72, 73 become close. As such, as shown in FIG. 6(*b*), the vial B is held by the arms 72, 73 of the body of the holding means 70.

Figure 7:
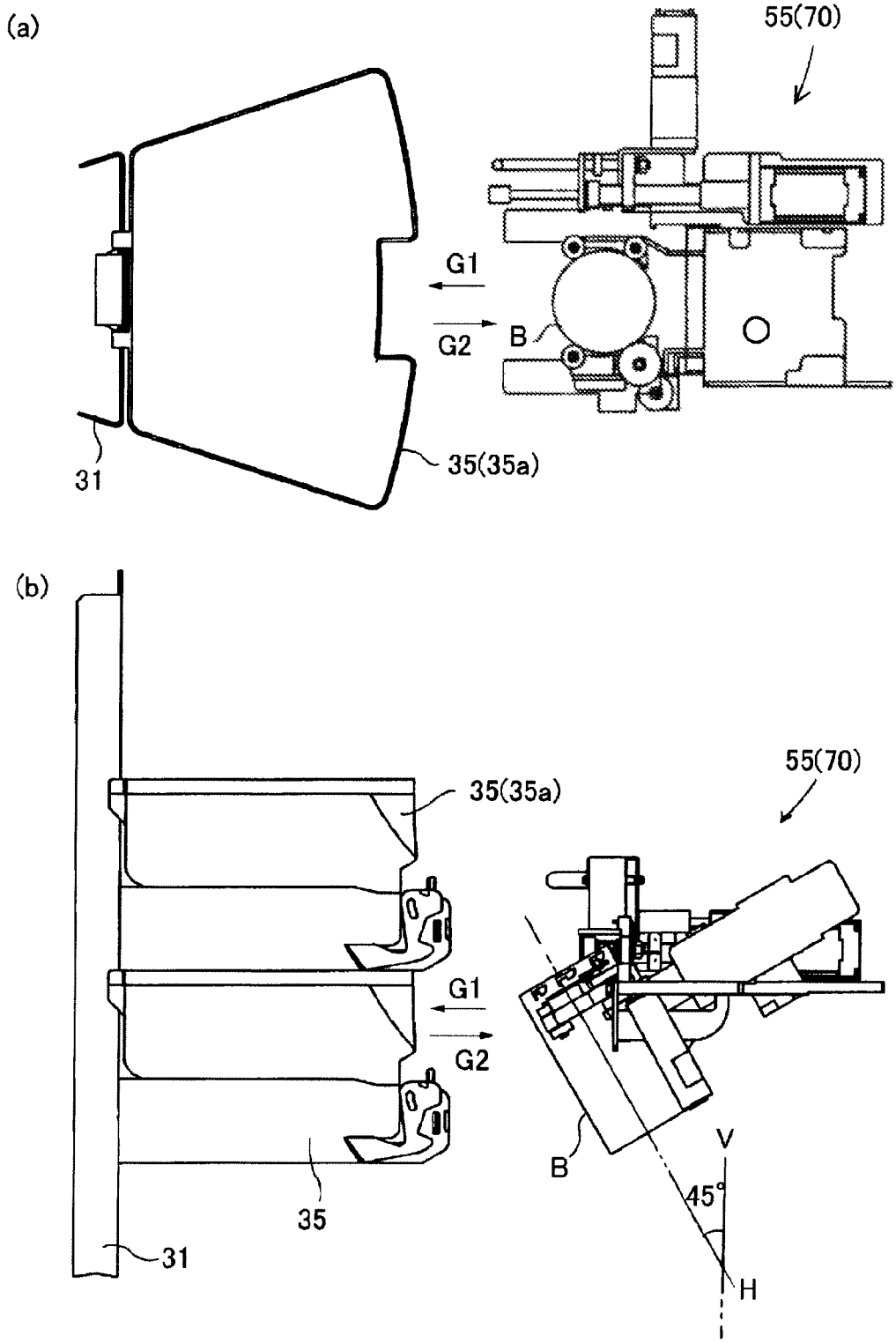
FIG. 7(*a*) is a plan view showing one phase of the operation of the container conveying means and FIG. 7(*b*) is a side elevation view of FIG. 7(*a*).

If the vial B is held by the arms 72, 73, then the control means 15 actuates the motor (not shown) provided at the tablet feeding means 30 to rotate the drum body 31. At the same time, it actuates the container conveying means 50 to carry out position adjustment such that the predetermined tablet cassette 35, which accommodates the tablets to be filled into the vial B (or prescribed tablets) (hereinafter referred to as the tablet cassette 35*a*), and the container conveying means 50 are opposed to each other as shown in FIGS. 7(*a*) and 7(*b*). More specifically, the control means 15 actuates the drum body 31 up to a position where the above-mentioned tablet cassette 35 is opposed to the supporting pillar 51 of the container conveying means 50.

Further, the control means 15 actuates the motor 65 of the container holding means 55 to rotate the pinion 66 and slide the body of the holding means 70 in a direction toward the supporting pillar 70. Thereafter, the control means 15 actuates the motor (not shown) for operating the gear belt 53 to thereby move the container holding means 55 up to a height at which the tablet cassette 35*a* accommodating the tablets to be filled into the vial B is set. Thus, the container holding means 55 and the tablet cassette 35*a* can oppose each other.

While the height adjustment of the container holding means 55 is carried out as described above or at the time of completing the height adjustment of the container holding means 55, the control means 15 actuates the tilting mechanism section 80 to tilt the vial B held by the arms 72, 73, as shown in FIG. 7(*b*). That is, the control means 15 actuates the motor 85 provided at the tilting mechanism portion 80 to rotate the worm gear 86. Thus, the gear 84 mounted to the body of the tilting mechanism 81 is rotated. The tilts of the body of the tilting mechanism 81 and the arms 72, 73, the base ends of which are accommodated in the body of the tilting mechanism, are changed. This accomplishes a frontward tilting position, i.e., a position where the opening of the vial B faces toward the tablet cassette 35*a* opposed to the container holding means 55. When an axis H of the vial B is inclined by about 45 degrees with respect to a vertical line V, the control means 15 stops the motor 85.

When the tilt adjustment of the vial B and the height adjustment of the container holding means 55 are completed, the control means 15 actuates the motor 65 provided at the container holding means 55 to rotate the pinion 66. This slides the body of the holding means 70 in a direction away from the supporting pillar 51, i.e., in a direction toward the tablet cassette 35*a* (in a direction indicated by an arrow G1 of FIGS. 7(*a*) and 7(*b*)). As a result, the lid member 38 of the tablet cassette 35*a* is pressed by the pressing piece 79 provided at the body of the holding means 70 and the discharge port 37 is opened thereby, as shown in FIG. 8(*b*).

Figure 8:
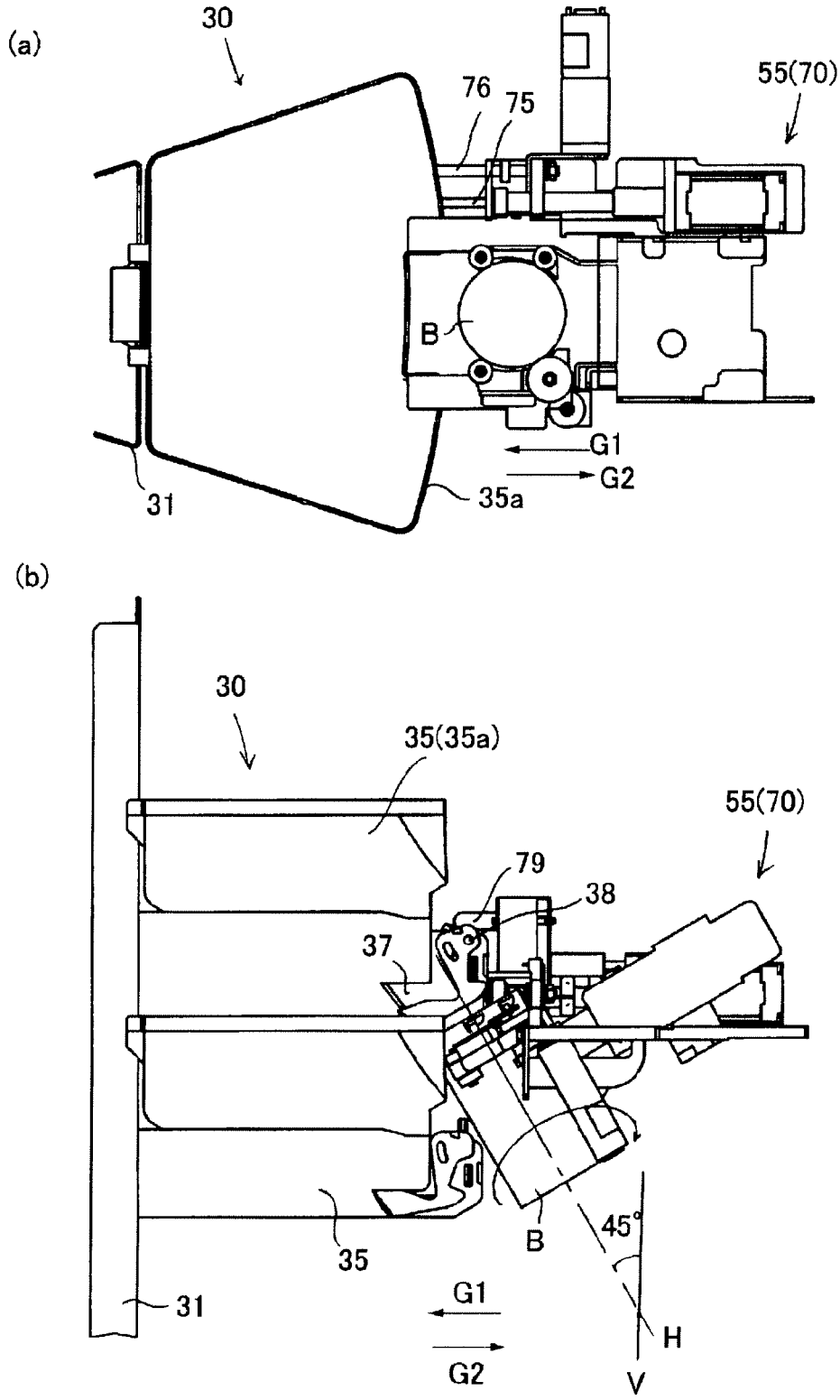
FIG. 8(*a*) is a plan view showing another phase of the operation of the container conveying means and FIG. 8(*b*) is a side elevation view of FIG. 8(*a*).
Figure 9:
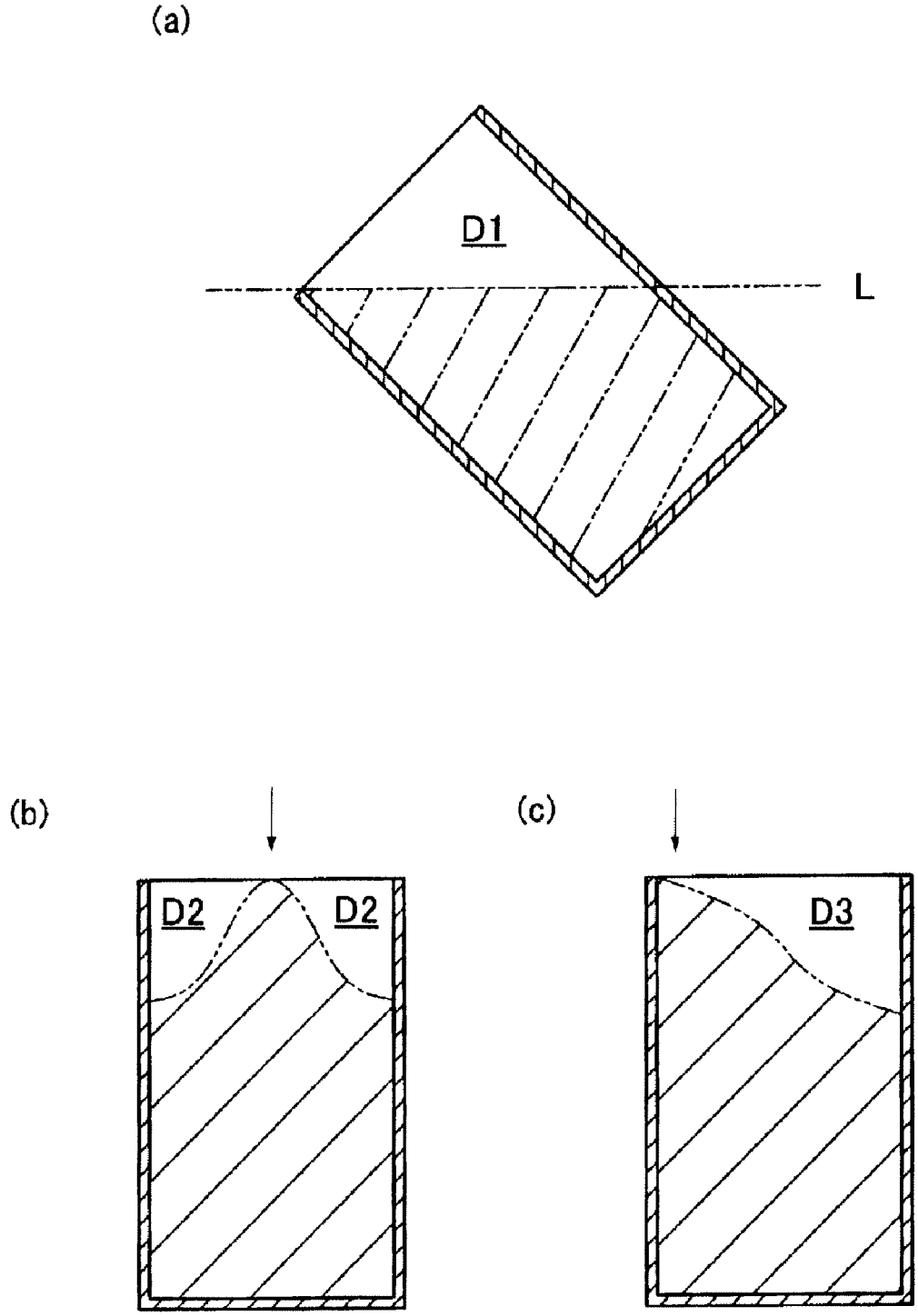
FIGS. 9(*a*) to 9(*c*) schematically show one example of filling tablets into a vial according to the prior art.

As the body of the holding means 70 comes up to the vicinity of the tablet cassette 35*a*, as shown in FIG. 8(*b*), the opening portion of the vial B held by the aims 72, 73 of the body of the holding means 70 becomes adjacent to the discharge port 37 of the tablet cassette 35*a*. Further, the tablet cassette operating shaft 75 provided at the body of the holding means 70 is connected to the connecting part 39 of the tablet cassette 35*a*. At the same time, the positioning shaft 76 is fitted to the positioning hole 34 of the tablet cassette 35*a*. Thus, the positional match between the container holding means 55 of the container conveying means 50 and the tablet cassette 35*a* is accomplished. As such, the tablets can be dispensed from the tablet cassette 35*a* to the vial B.

If the positional match between the container holding means 55 and the tablet cassette 35*a* is accomplished, then the control means 15 actuates the motor 110 to thereby rotate the tablet cassette operating shaft 75 and dispense a predetermined amount of the tablets from the tablet cassette 35*a*. The tablets dispensed from the tablet cassettes 35*a* are filled into the vial B, which is held obliquely downward relative to the discharge port 37.

If filling the tablets into the vial B starts as described above, then the control means 15 actuates the container rotating mechanism 100 to thereby rotate the vial circumferentially about an axis H of the vial B. More specifically, the control means 15 actuates the motor 105 to thereby rotate the drive roller 101 via the pulley 106 and the belt 107 suspended thereto.

In the medicine storing and dispensing apparatus 1, when the vial B is sandwiched by the arms 72, 73 of the container holding means 55, the drive roller 101 and the free rollers 102, 103, 104 provided at the left-hand holding member 96 and the right-hand holding member 97 are in contact with the body portion of the vial B. Thus, as the drive roller 101 starts to rotate in conjunction with the operation of the motor 105, the vial B is rotated circumferentially as indicated by an arrow shown in FIG. 8(*b*).

When the tablets are dispensed by the predetermined amount after dispensing the tablets from the tablet cassette 35*a* to the vial B begins, the control means 15 stops energizing the motor 110 to stop dispensing the tablets. At the same time, it stops energizing the motor 105 to stop rotating the vial B. Thereafter, the control means 15 moves the container conveying means 50 in sequence, which is reverse to the above-described sequence. That is, the control means 15 actuates the motor 65, so as to move the container holding means 55 in a direction away from the tablet cassette 35*a* (in the direction of the arrow G2 shown in FIGS. 7 and 8).

When the container holding means 55 is moved or has been moved from the tablet cassette 35*a* to the supporting pillar 51, the control means 15 actuates the tilting mechanism section 80 to return the vial B held by the arms 72, 73 to a horizontal position, i.e., a position where the opening of the upper end of the vial B is directed to an approximately vertical upper side. That is, the control means 15 rotates the gear 84 provided to the body of the tilting mechanism 81 by actuating the motor 85 provided at the tilting mechanism section 80. This rotates the worm gear 86 and causes the body of the tilting mechanism 81 as well as the arms 72, 73 to be placed approximately horizontally.

If the vial B returns to the approximately horizontal position, then the control means 15 checks out whether or not the tablets should be dispensed from another tablet cassette 35 (hereinafter referred to as the tablet cassette 35*b*) to the vial B held by the arms 72, 73. In case the tablets dispensed from the tablet cassette 35*b* must be filled into the vial B, the container conveying means 50 is actuated. As such, the tablets are dispensed from the tablet cassette 35*b* to be filled into the vial B similar to when filling the tablets dispensed from the tablet cassette 35*a*.

If filling the tablets from the tablet cassette 35*a* and another tablet cassette 35*b* into the vial B is completed, then the container conveying means 50 is moved with the vial B horizontally held by the arms 72, 73 and the vial B is delivered to the container sealing means 40. Specifically, the control means 15 energizes the motor (not shown) provided at the supporting pillar 51 to operate the gear belt 53 or energizes the motor 65 to operate the moving mechanism including the rack 77 and the pinion 66 (i.e., a rack and pinion mechanism). This is so that the vial B is moved up to a position of the container sealing means 40 as held by the arms 72, 73. Thereafter, if the vial B reaches the container sealing means 40, then the control means 15 energizes the motor 95 of the arm operating mechanism 90 to open up the arms 72, 73 such that the vial B is delivered to the container sealing means 40.

If delivering the vial B from the container conveying means 50 to the container sealing means 40 is completed, then the control means 15 actuates the container sealing means 40 to seal up the opening portion of the vial B by means of a cap (not shown). The vial B with the opening sealed up is conveyed by a conveying means (not shown) up to a position of the medicine storing and dispensing apparatus 1, where a user can take out the vial. As such, serial filling operations for the vial are finished.

As described above, the medicine storing and dispensing apparatus 1 of this embodiment is constructed such that the container holding means 55 holds the vial B by means of the arms 72, 73 and can rotate the vial B while maintaining a position where the tablets can be filled into the vial B. Thus, the medicine storing and dispensing apparatus 1 of this embodiment can prevent the tablets from being distributed to only one region of the vial B and allow the vial B to evenly accommodate the tablets when filling the tablets dispensed from the tablet cassette 35 into the vial. Consequently, according to the medicine storing and dispensing apparatus 1 of this embodiment, most of the internal space of the vial B can be effectively utilized for filling of the tablets.

As described above, the medicine storing and dispensing apparatus 1 of this embodiment has the tilting mechanism section 80 and can thus fill the tablets dispensed from the tablet cassette 35 into the vial B as the vial B is tilted. Thus, the medicine storing and dispensing apparatus 1 of the present invention does not need to have a superfluous space for setting the vial B below the tablet cassette 35 and can arrange the tablet cassettes 35 with high density in a vertical direction.

Since the medicine storing and dispensing apparatus 1 may fill the tablets into the vial B with the vial B tilted, falling distances of the tablets become short when compared to a case where the tablets are dispensed from the tablet cassette 35 with the vial B approximately upright and then fall to the vial B. Accordingly, the medicine storing and dispensing apparatus 1 of this embodiment can restrict the tablets from breaking or splitting due to an impact caused by the falling of the tablets during filling of the tablets.

Further, it is illustrated in the above-described embodiment that the medicines are filled into the vial B when the vial B is tilted such that the axis H of the vial B is inclined by about 45 degrees toward the tablet cassette 35 with respect to the vertical line V. However, the present invention should not be limited thereto. The tilting angle of the vial B may be appropriately adjusted in view of an efficiency of filling the tablets into the vial B, a size of a working area of the container holding means 50 and an arrangement density of the tablet cassettes 35. More specifically, the tilting angle may be appropriately adjusted within a range of 0 degree to 60 degrees of the inclination (inclination angle) of the axis H relative to the vertical line V, i.e., within a range from the position where the opening of the vial B is directed to an approximately vertical upper side to the position where it is tilted at an angle of about 60 degrees toward the tablet cassette 35.

It is illustrated in the medicine storing and dispensing apparatus 1 of the above-described embodiment that a plurality of the tablet cassettes 35 are arranged on the outer periphery of the approximately cylindrical drum body 31 in the height direction and the circumferential direction thereof. It is further illustrated that the container conveying means 50 is disposed outside the drum body 31 and the tablet cassette 35 and the container conveying means 50 can be moved by circumferentially rotating the drum body 31 by the motor (not shown). However, the present invention should not be limited thereto. More specifically, when the container conveying means 50 can be rotated circumferentially throughout the outer periphery of the tablet feeding means 30 and both or one of the container conveying means 50 and the tablet feeding means 30 can rotate, the container conveying means 50 may be rotated with respect to the tablet feeding means 30. Moreover, similar to the conventional medicine storing and dispensing apparatus disclosed in the above-mentioned reference, the tablet cassette 35 may be mounted to an inner peripheral surface of the drum body 31 and an equivalent to the container conveying means 50 may be disposed inside the drum body 31. Further, the container conveying means 50 can be circumferentially rotated inside the drum body 31.

The tablet feeding means 30 is configured such that a plurality of the tablet cassettes 35 are mounted to the drum body 31 having an approximately cylindrical shape, as described above. However, the present invention should not be limited thereto. For example, a plurality of the tablet cassettes 35 may be arranged in rows on a certain plane in a vertical direction as well as in right and left directions. In such a case, if the medicine storing and dispensing apparatus 1 is constructed to be capable of moving the container holding means 55 in upward and downward directions as well as in right and left directions, then a medicine storing and dispensing apparatus, which can move a vial B up to a position adjacent to the predetermined tablet cassette 35 and can fill the tablets such a vial, can be provided similar to the medicine storing and dispensing apparatus 1 of this embodiment.

The medicine storing and dispensing apparatus 1 of this embodiment is constructed such that the drive roller 101 and the free rollers 102, 103, 104 are placed into contact with the body portion of the vial B to rotate the same. As such, it is preferable that an outer shape of the vial B has an approximately cylindrical shape so that the vial B can be firmly held and smoothly rotated. However, the present invention should not be limited thereto. For example, any other suitably shaped vial such as a cylindrical body, which has a polygonal cross-sectional shape as its outer shape, can be employed as the vial B.

It should be understood that a structure of the moving mechanism including a combination of the rack 77 and the pinion 66, a structure of the tilting mechanism section 80, the arm operating mechanism 90 for operating the arms 72, 73, and a structure of the container rotating mechanism 100 are merely one aspect of the present invention. It should be further understood that any other operating mechanism capable of performing similar operations may be employed.

The invention claimed is:

1. A medicine storing and dispensing apparatus, comprising:

a medicine feeding means for accommodating medicines and dispensing the same; and a container holding means for holding a container, wherein the container holding means has a holding portion and a container rotating means, wherein the container holding means rotates the container while the holding portion holds the container in a position at which the medicine feeding means dispenses the medicines into the container, wherein the holding portion includes a pair of arms configured to move relative to each other wherein the container is held by reducing a space between the pair of the arms and the container is released by increasing the space between the pair of the arms, wherein a roller is provided in association with at least one arm of the pair of the arms, the roller rotating response to power from an actuator, and wherein when the container is held, the roller is brought into contact with an outer peripheral surface of the container.

2. The medicine storing and dispensing apparatus of claim 1, wherein the container has a cylindrical body with a bottom, the cylindrical body extending along a predetermined axis, and wherein while the medicine feeding means dispenses the medicines into the container, the container holding means holds the container such that an axial direction of the container is inclined with respect to a vertical line.

3. The medicine storing and dispensing apparatus of claim 2, wherein the medicine feeding means comprises:

a plurality of medicine cassettes disposed in rows; and a container conveying means for moving the container holding means towards and away from the medicine cassette, and wherein the medicine cassette and the container holding means are moved in a direction where the medicine feeding means is in a row.

4. The medicine storing and dispensing apparatus of claim 1, wherein the medicine feeding means comprises:

a plurality of medicine cassettes disposed in rows; and a container conveying means for moving the container holding means towards and away from the medicine cassette, and wherein the medicine cassette and the container holding means are moved in a direction where the medicine feeding means is in a row.

* * * * *